US009243636B2

(12) United States Patent
Kim et al.

(10) Patent No.: US 9,243,636 B2
(45) **Date of Patent: *Jan. 26, 2016**

(54) SCROLL COMPRESSOR WITH DIFFERENTIAL PRESSURE HOLE AND COMMUNICATION HOLE

(75) Inventors: Byoungchan Kim, Seoul (KR); Seheon Choi, Seoul (KR); Byeongchul Lee, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/005,158

(22) PCT Filed: Mar. 14, 2012

(86) PCT No.: PCT/KR2012/001844

§ 371 (c)(1),
(2), (4) Date: Sep. 13, 2013

(87) PCT Pub. No.: WO2012/128499

PCT Pub. Date: Sep. 27, 2012

(65) Prior Publication Data

US 2013/0343941 A1 Dec. 26, 2013

(30) Foreign Application Priority Data

Mar. 24, 2011 (KR) ..... 10-2011-0026587

(51) Int. Cl.
*F03C 2/00* (2006.01)
*F03C 4/00* (2006.01)
(Continued)

(52) U.S. Cl.
CPC ..... *F04C 18/0215* (2013.01); *F04C 18/0261* (2013.01); *F04C 23/008* (2013.01);
(Continued)

(58) Field of Classification Search
USPC ..... 418/55.1–55.6, 57, 88, 94, 99, 270, 418/DIG. 1
See application file for complete search history.

(56) References Cited

U.S. PATENT DOCUMENTS 4,669,962 A 6/1987 Mizuno et al.
6,074,186 A * 6/2000 Lifson et al. ..... 418/55.6
(Continued)

FOREIGN PATENT DOCUMENTS

CN 1215806 5/1999
CN 1510274 7/2004
(Continued)

OTHER PUBLICATIONS

European Search Report dated Sep. 15, 2014.
(Continued)

*Primary Examiner* — Theresa Trieu
(74) *Attorney, Agent, or Firm* — Ked & Associates LLP

(57) ABSTRACT

A scroll compressor is provided that includes an oil recollecting pump to recollect oil discharged from a shell, thus to effectively recollect oil discharged out of the compressor, and a differential pressure hole formed at a position where it communicates with compression chambers after a suction completion timing, such that oil stored in an inner space of the shell can be supplied into the compression chambers using a pressure difference between a high-pressure inner space of the shell and a low-pressure compression chambers, resulting in allowing oil to be smoothly supplied to a compression unit even during low-speed driving of the compressor and preventing an occurrence of a suction loss due to oil.

17 Claims, 7 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 29/02*** | (2006.01) |
| ***F04C 23/00*** | (2006.01) |

(52) U.S. Cl.

CPC ..... *F04C29/023* (2013.01); *F04C 29/025* (2013.01); *F04C 29/028* (2013.01); *F04C 29/026* (2013.01); *F04C 2240/603* (2013.01); *F04C 2240/809* (2013.01)

(56) References Cited

U.S. PATENT DOCUMENTS

| | | | | |
|---|---|---|---|---|
| 2009/0035160 | A1* | 2/2009 | Yoo et al. | 418/88 |
| 2010/0122549 | A1* | 5/2010 | Cho et al. | 418/88 |
| 2010/0215534 | A1* | 8/2010 | Kiyokawa et al. | 418/55.5 |
| 2010/0215535 | A1* | 8/2010 | Kiyokawa et al. | 418/55.5 |

FOREIGN PATENT DOCUMENTS

| | | | |
|---|---|---|---|
| EP | 0 911 526 | | 4/1999 |
| EP | 1 526 283 | | 4/2005 |
| KR | 10-1987-0001409 | A | 3/1987 |
| KR | 10-2006-0103218 | A | 9/2006 |
| KR | 10-2009-0013041 | | 2/2009 |
| KR | 10-2010-0097022 | A | 9/2010 |

OTHER PUBLICATIONS

International Search Report and Written Opinion dated Sep. 20, 2012 issued in Application No. PCT/KR2012/001844.

Chinese Office Action dated Apr. 16, 2015. (English Translation).

* cited by examiner

SCROLL COMPRESSOR WITH DIFFERENTIAL PRESSURE HOLE AND COMMUNICATION HOLE

TECHNICAL FIELD

The present disclosure relates to a scroll compressor capable of supplying oil within a shell into compression chambers using differential pressure.

BACKGROUND ART

A refrigerant compression type refrigeration cycle includes a compressor, a condenser, an expansion apparatus and an evaporator which are connected by a refrigerant pipe of a closed curve, and a refrigerant compressed in the compressor then circulates sequentially via the condenser, the expansion apparatus and the evaporator.

The compressor requires a predetermined amount of oil for lubrication of a driving unit, sealing and cooling of a compression unit, and the like. Therefore, a predetermined amount of oil has to be stored in a shell of the compressor. However, such oil is partially discharged from the compressor in a mixed state with a refrigerant, and then circulates together with the refrigerant via the condenser, the expansion apparatus and the evaporator. Here, if an excessive amount of oil circulates in the refrigeration cycle or a large amount of oil remains in the refrigeration cycle without being recollected into the compressor, oil deficiency inside the compressor is caused. This may lower reliability of the compressor and the refrigeration cycle may have a lowered heat exchange performance.

In order to solve these problems, the applicant of this application has introduced a technology, in Korean Patent Application No. 10-2008-0070335, filed on Jul. 18, 2008, titled "Hermetic compressor and refrigeration cycle apparatus having the same" that an oil separator is installed at a discharge side of the compressor, an oil pump is installed to recollect oil separated in the oil separator, and the oil separator and the oil pump are connected via an oil recollecting pipe. Accordingly, even if an inner space of the shell is filled with discharge pressure, the oil separated in the oil separator can be smoothly recollected. However, in the previously filed "compressor", the oil pump is installed at a lower end of a crankshaft, which causes a pumping force to be deficient during low-speed driving of the compressor, which might have a problem of lowering reliability of the compressor.

There has been introduced a technology using differential pressure as a solution for constantly maintaining an amount of pumped oil even during low-speed driving of the compressor. Patent Application Laid Open No. U.S. 2005/0220652, filed on Oct. 6, 2005, titled Compressor has introduced a technology in which a differential pressure generating hole is formed through an orbiting scroll to communicate an inner space of a shell as a high pressure part with a suction groove (more concretely, a thrust bearing surface between scrolls) as a low pressure part, such that oil can be pumped by an attractive force generated due to a pumping force of an oil pump and pressure difference, thereby allowing the oil to be smoothly pumped up even during low-speed driving of the compressor, which results in improved reliability of the compressor.

The oil pumping technology using the attractive force generated due to the pumping force of the oil pump and the pressure difference in the related art allows oil to be smoothly supplied into the compression unit even during the low-speed operation by virtue of high pressure difference between the inner space of the shell and the suction groove, thereby preventing compression loss or damage of the compressor due to oil deficiency.

DISCLOSURE OF INVENTION

Technical Problem

However, as the inner space of the shell and the suction groove of the compression unit are directly connected to each other, the oil is supplied from the inner space of the shell directly into the suction groove. Accordingly, an amount of sucked refrigerant is rather reduced as much as an amount of oil introduced. This causes intake loss of the refrigerant, thereby causing a cooling capability of the compressor to be lowered.

Solution To Problem

Therefore, to obviate those problems, an aspect of the detailed description is to provide a compressor capable of effectively recollecting oil discharged from the compressor, and preventing beforehand an occurrence of intake loss due to oil as well as smoothly supplying oil into a compression unit even during low-speed driving.

To achieve these and other advantages and in accordance with the purpose of the present invention, as embodied and broadly described herein, there is provided a scroll compressor including a shell having an inner space filled with discharge pressure, the inner space storing a predetermined amount of oil, a driving motor installed in the inner space of the shell, a crankshaft coupled to a rotor of the driving motor, and having an oil passage formed therethrough, a fixed scroll fixed to the inner space of the shell and having a fixed wrap, and an orbiting scroll having an orbiting wrap engaged with the fixed wrap and eccentrically coupled to the crankshaft, and configured to form compression chambers together with the fixed scroll with performing an orbiting motion with respect to the fixed scroll, wherein a differential pressure hole may be formed through the fixed scroll to communicate the inner space of the shell with the compression chambers, wherein the differential pressure hole may include a first opening end communicating with the inner space of the shell and a second opening end communicating with the compression chambers, the first opening end and the second opening end communicating with each other, and wherein the second opening end may communicate with the compression chambers after the suction completion timing, the suction completion timing is a timing when a suction side end of the orbiting wrap contacts a side surface of the fixed wrap.

Advantageous Effects of Invention

In accordance with the detailed description, a scroll compressor includes an oil recollecting pump for recollecting oil discharged from a shell so as to effectively recollect oil discharged from the compressor. Also, oil stored in an inner space of the shell can be supplied into compression chambers using pressure difference between the inner space of the shell as a high pressure part and the compression chambers as a low pressure part, resulting in smoothly supplying oil to a compression unit even during low-speed driving of the compressor and preventing beforehand an occurrence of intake loss due to oil.

BEST MODE FOR CARRYING OUT THE INVENTION

Embodiments of the present invention will be described below in detail with reference to the accompanying drawings where those components are rendered the same reference number that are the same or are in correspondence, regardless of the figure number, and redundant explanations are omitted. In describing the present invention, if a detailed explanation for a related known function or construction is considered to unnecessarily divert the gist of the present invention, such explanation has been omitted but would be understood by those skilled in the art. The accompanying drawings are used to help easily understood the technical idea of the present invention and it should be understood that the idea of the present invention is not limited by the accompanying drawings. The idea of the present invention should be construed to extend to any alterations, equivalents and substitutes besides the accompanying drawings.

Hereinafter, description will be given of a compressor in accordance with the exemplary embodiments with reference to the accompanying drawings.

Figure 1:
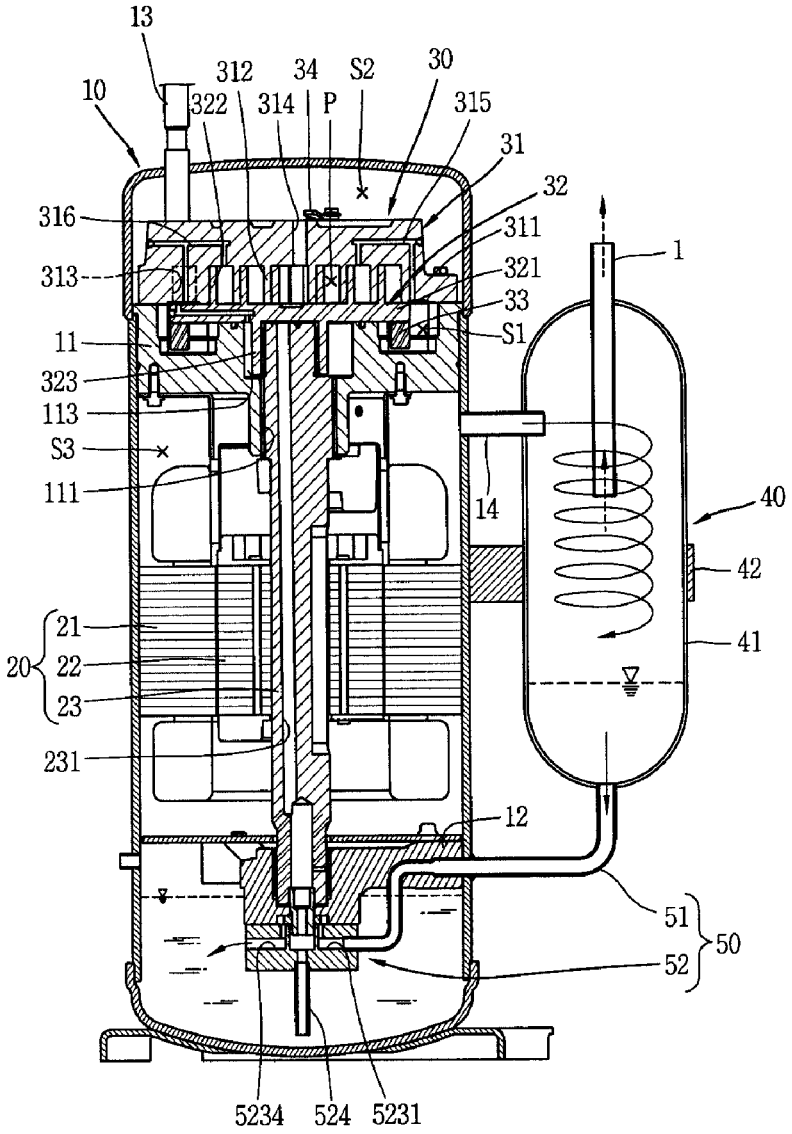
FIG. 1 is a longitudinal sectional view showing an inner structure of a scroll compressor according to this specification.
Figure 2:
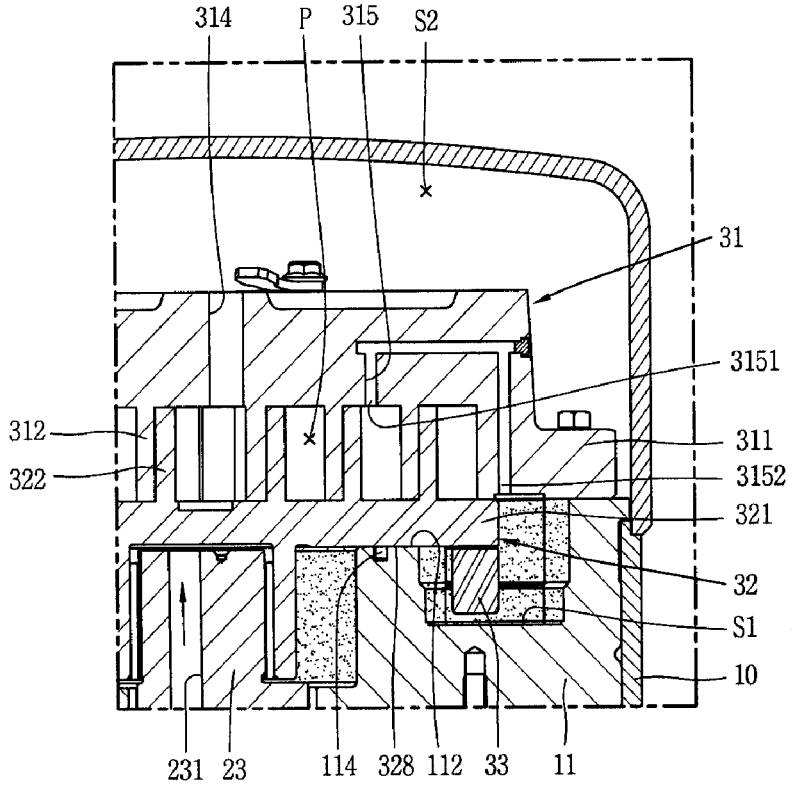
FIG. 2 is a longitudinal sectional view showing a part of a compression unit for illustrating a back pressure channel in the scroll compressor of FIG. 1.
Figure 3:
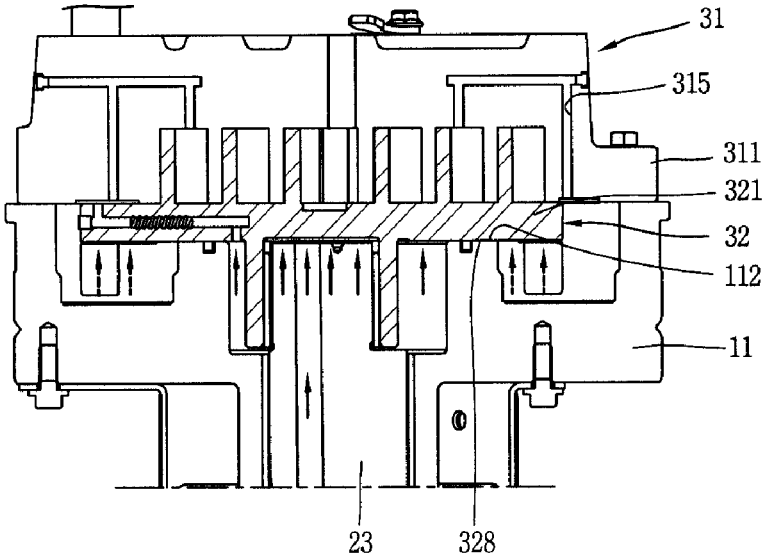
FIG. 3 is a schematic view showing a sealing effect between a fixed scroll and an orbiting scroll by virtue of the back pressure channel according to FIG. 2.

FIG. 1 is a longitudinal sectional view showing an inner structure of a scroll compressor according to this specification, FIG. 2 is a longitudinal sectional view showing a part of a compression unit for illustrating a back pressure channel in the scroll compressor of FIG. 1, and FIG. 3 is a schematic view showing a sealing effect between a fixed scroll and an orbiting scroll by virtue of the back pressure channel according to FIG. 2.

As shown in the drawings, a scroll compressor may include a shell 10 having a hermetic inner space, a driving motor 20 installed in the inner space of the shell 10, and a compression unit 30 driven by the driving motor 20 and having a fixed scroll 31 and an orbiting scroll 32 for compressing a refrigerant.

The inner space of the shell 10 may be filled with a refrigerant of discharge pressure. A suction pipe 13 may penetrate through one side of the shell 10 to communicate directly with a suction groove 313 of a fixed scroll 31 to be explained later. A discharge pipe 14 may be connected to another side of the shell 10 so as to guide a refrigerant discharged into the inner space of the shell 10 toward a refrigeration cycle.

The driving motor 20 may be configured such that a winding coil is wound on a stator 21 in a concentrated winding manner. The driving motor 20 may be a constant speed motor which rotates a rotor 22 at a constant speed. Alternatively, an inverter motor, which may vary a rotation speed of the rotor 22, may be used in consideration of multi-functionalization of refrigerators to which a compressor is applied. The driving motor 20 may be supported by a main frame 11 and a sub frame 12 fixed to both upper and lower sides of the shell 10.

The compression unit 30 may include a fixed scroll 31 coupled to the main frame 11, an orbiting scroll 32 for forming a pair of compression chambers P which consecutively move by being engaged with the fixed scroll 31, an Oldham s ring 33 installed between the orbiting scroll 32 and the main frame 11 for inducing an orbiting motion of the orbiting scroll 32, and a check valve 34 installed to open and close a discharge opening 314 of the fixed scroll 31, for preventing backflow of gas discharged through the discharge opening 314.

The fixed scroll 31 may be provided with a fixed wrap 312 at a lower surface of a disc part 311 for forming the compression chambers P, a suction groove 313 formed at a side (edge) of the disc part 311, and a discharge opening 314 formed at a central portion of the disc part 311. The suction pipe 13 may be directly connected to the suction groove 313 of the fixed scroll 31 to guide a refrigerant from the refrigeration cycle.

The orbiting scroll 32 may be provided with an orbiting wrap 322 formed on an upper surface of a disc part 321 for forming the compression chambers P by being engaged with the fixed wrap 312, a shaft receiving portion 323 formed at a lower surface of the disc part 321 and coupled to a crankshaft 23. The shaft receiving portion 323 may extend to a shaft receiving hole 111 of the main frame 11 to be orbitably inserted into an orbiting space recess 113, which is recessed into a thrust bearing surface 112 by a predetermined depth.

A back pressure chamber S1 may be formed at a side of a rear surface of the orbiting scroll 32. The back pressure chamber S1 may define an intermediate pressure space by the orbiting scroll 32, the fixed scroll 31 and the main frame 11. Between the main frame 11 and the orbiting scroll 32 may be formed a sealing member 114 for preventing oil sucked up through an oil passage 231 of the crankshaft 23 from being excessively introduced into the back pressure chamber S1. The sealing member 114 may be located between the orbiting space recess 113 of the main frame 11 and the back pressure chamber S1.

Referring to FIG. 2, a back pressure hole may be formed at the fixed scroll 31. The back pressure hole 315 may induce a, part of refrigerant within an intermediate compression chamber, having intermediate pressure between suction pressure and discharge pressure, toward the back pressure chamber S1 so as to support the side (edge) of the orbiting scroll 32 in a thrust direction. The back pressure hole 315 may be formed to communicate a first opening end 3151, which communicates with the compression chambers P, with a second opening end 3152, which communicates with the back pressure chamber S1. The first opening end 3151 of the back pressure hole 315 may be located at a position at which it can independently communicate with both of the compression chambers in an alternating manner. Also, the first opening end 3151 may preferably be formed not to be larger than a wrap thickness of the orbiting wrap 322 in order to prevent a refrigerant leakage at the pair of compression chambers P.

With the configuration of the scroll compressor, once power is supplied to the driving motor 20, the crankshaft 23 is rotated together with the rotor 22 to transmit a rotational force to the orbiting scroll 32. Then, the orbiting scroll 32 having received the rotational force performs an orbiting motion on an upper surface of the main frame 11 by an eccentric distance, thereby forming a pair of compression chambers P which consecutively move between the fixed wrap 312 of the fixed scroll 31 and the orbiting wrap 322 of the orbiting scroll 32. As the compression chambers P have a decreased volume by moving toward their center, a sucked refrigerant is compressed. Here, as shown in FIG. 3, a central portion of the orbiting scroll 32 is supported by oil introduced into the orbiting space recess 113 and the side portion of the orbiting scroll 32 is supported by a refrigerant introduced from the compression chambers P into the back pressure chamber S1 via the back pressure hole 315. Consequently, the refrigerant is compressed well without being leaked out.

The refrigerant compressed in the compression chambers P is consecutively discharged into an upper space S2 of the shell 10 via the discharge opening 314 of the fixed scroll 31, flows into a lower space S3 of the shell 10, and then is discharged into a refrigeration cycle system via the discharge pipe 14. Here, an oil separating unit 40 for separating oil from a refrigerant, which is discharged from the shell 10 into the refrigeration cycle via the discharge pipe 14, may be installed at a middle portion of the discharge pipe 14. An oil recollecting unit 50 for recollecting the oil separated in the oil separating unit 40 toward the shell 10 may be installed at the oil separating unit 40.

The oil separating unit 40, as shown in FIG. 1, may include an oil separator 41 disposed at one side of the shell 10 in parallel thereto, and an oil separating member (not shown) installed in the oil separator 41 to separate oil from the refrigerant discharged from the compression unit 30. The discharge pipe 14 may be connected to a middle portion of a side wall surface of the oil separator 41 to support the oil separator 41, or a separate support member 42, such as a clamp, may be disposed between the shell 10 and the oil separator 41 to support the oil separator 41. A refrigerant pipe 1 may be connected to an upper end of the oil separator 41 to allow the separated refrigerant to flow to a condenser of the refrigeration cycle, and an oil recollecting pipe 51 which will be explained later may be connected to a lower end of the oil separator 41 to guide the separated oil in the oil separator 41 to be recollected into the shell 10 or the compression unit 30 of the compressor.

Various methods for separating oil may be employed, such as the oil separating unit 40 having a mesh screen installed inside the oil separator 41 to make the refrigerant and the oil separated, or the discharge pipe 14 being connected in an inclined state to make the relatively heavy oil separated while the refrigerant is rotated in a cyclone shape.

The oil recollecting unit 50 may include an oil recollecting pipe 51 connected to the oil separator 41 for guiding the oil separated in the oil separator 41 toward the shell 10, and an oil recollecting pump 52 connected to the oil recollecting pipe 51 for pumping the separated oil toward the shell 10.

The oil recollecting pipe 51 may have one end connected to a lower end of the oil separator 41 and the other end penetrating through the shell 10 to be connected to an inlet of the oil recollecting pump 52. The oil recollecting pipe 51 may be implemented as a metal pipe having predetermined rigidity for stably supporting the oil separator 41. The oil recollecting pipe 51 may be bent by an angle that the oil separator 51 is disposed in parallel to the shell 10 in order to reduce vibration of the compressor. The oil recollecting pipe 51 may be coupled to a pump cover 523 of the oil recollecting pump 52, which will be explained later, by using a communication hole (reference numeral not given) formed at the sub frame 12.

Figure 4:
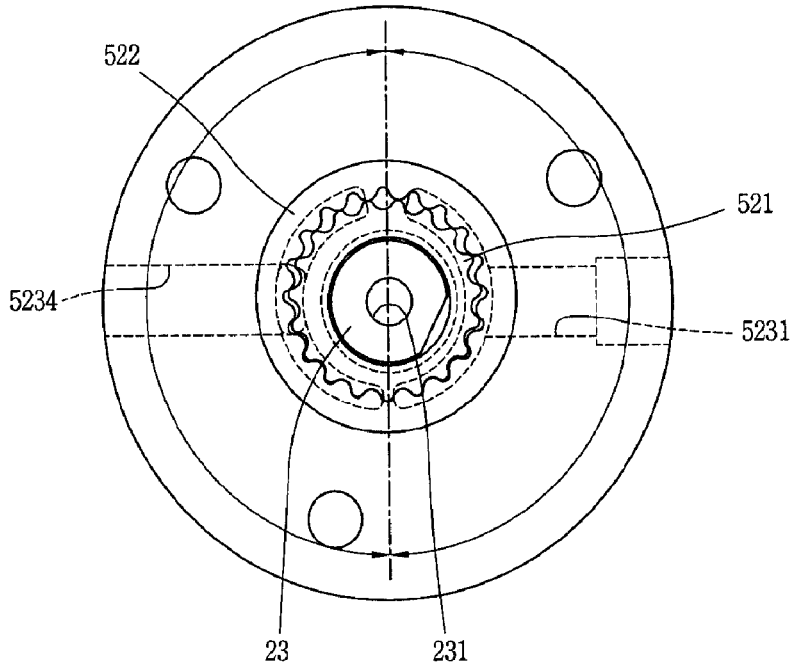
FIGS. 4 and 5 are a planar view and a longitudinal sectional view showing an oil recollecting pump according to FIG. 1.
Figure 5:
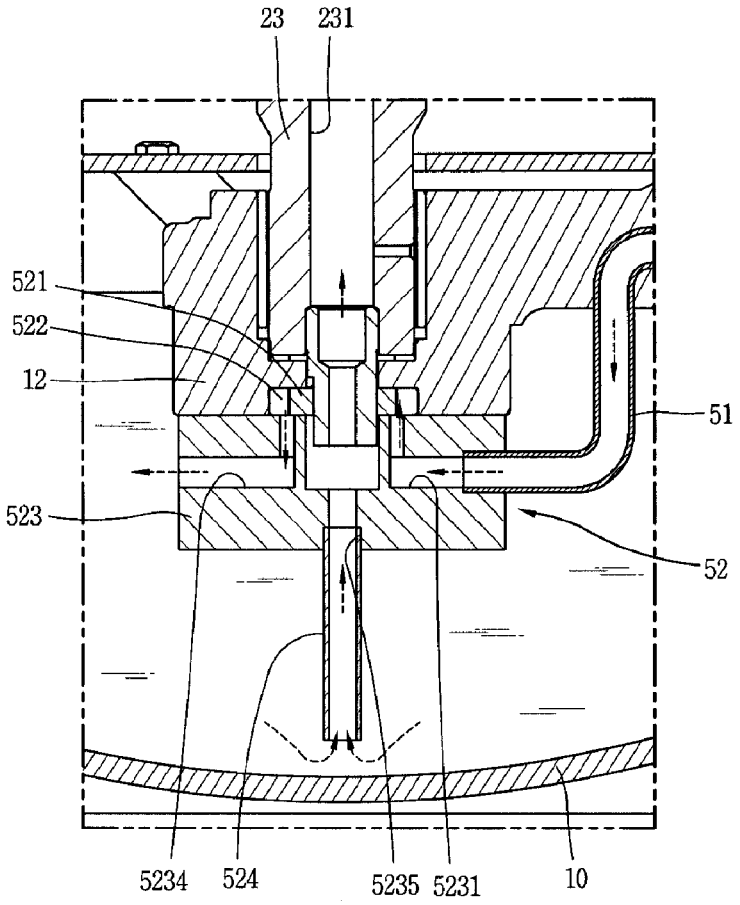
Figure 6:
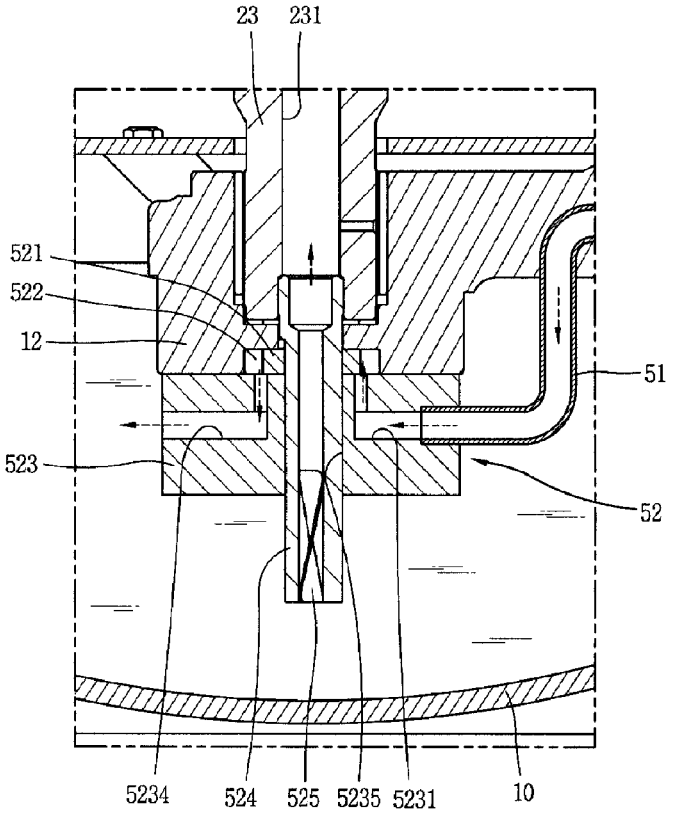
FIG. 6 is a longitudinal sectional view showing another exemplary embodiment of the oil recollecting pump according to FIG. 5.

FIGS. 4 and 5 are a planar view and a longitudinal sectional view showing an oil recollecting pump according to FIG. 1, and FIG. 6 is a longitudinal sectional view showing another exemplary embodiment of the oil recollecting pump according to FIG. 5.

As shown in FIGS. 4 and 5, the oil recollecting pump 52 may be implemented by various types of pumps. As shown in the exemplary embodiment, a trochoidal gear pump that a variable displacement is formed by engagement between an inner gear 521 and an outer gear 522 may be employed.

The inner gear 521 of the oil recollecting pump 52 may be coupled to the crankshaft 23 to be driven by a driving force of the driving motor 20. The inner gear 521 and the outer gear 522 may be received by a pump cover 523 fixed to the sub frame 12. The pump cover 523 may be provided with one inlet 5231 and one outlet 5234 each communicated with the variable displacement of the oil recollecting pump 52. The inlet 5231 may communicate with the oil recollecting pipe 51 while the outlet 5234 may communicate with an oil storage portion of the lower space S3 of the shell 10.

An oil hole 5235 may be formed at a central portion of the pump cover 523 so as to communicate with an oil passage 231 of the crankshaft 23. An oil supplying pipe 524, by which oil stored in the inner space of the shell 10 is guided into the oil passage 231 of the crankshaft 23, may be coupled to the oil hole 5235. Alternatively, as shown in FIG. 6, the oil supply pipe 524 may be coupled directly to the oil passage 231 of the crankshaft 23 through the oil hole 5235. When the oil supply pipe 524 is coupled directly to the crankshaft 23, a pumping member 525, such as a propeller, for generating a pumping force may be inserted into the oil supply pipe 524 so as to increase an oil pumping force when the oil supply pipe 524 is rotated together with the crankshaft 23.

In the oil separator 41 of the scroll compressor with the configuration, oil can be separated from a refrigerant, which is discharged from the inner space of the shell 10 to the refrigeration cycle, and the separated oil may be recollected into the inner space of the shell 10 by the oil recollecting pump 52.

More concretely, oil introduced in the compression chambers P is discharged in a mixed state with a refrigerant and then introduced into the oil separator 41 via the discharge pipe 14. The oil is separated from the refrigerant in the oil separator 41. The separated refrigerant moves into a condenser of the refrigeration cycle via the refrigerant pipe 1 and the separated oil is gathered in a bottom of the oil separator 41. Here, as the crankshaft 23 of the driving motor 20 is rotated, the inner gear 521 of the oil recollecting pump 52 is rotated to form a variable displacement between itself and the outer gear 522, thereby generating a pumping force. The oil separated in the oil separator 41 is then pumped by the pumping force. The oil pumped by the oil recollecting pump 52 is then recollected into the lower space S3 of the shell 10, which defines an oil storage portion, via the oil recollecting pipe 51 and the oil recollecting pump 52.

Here, the oil recollected into the inner space of the shell 10 is sucked up via the oil supply pipe 524 and the oil passage 231 of the crankshaft 23 so as to be supplied into a sliding part of the compression unit 30. In this specification, the inner space of the shell 10 forming a relative high pressure part may communicate with the compression chambers P forming a relative low pressure part, such that the oil recollected into the inner space of the shell 10 can be sucked up from the inner space of the shell 10 into the compression chambers P by pressure difference (differential pressure).

Figure 7:
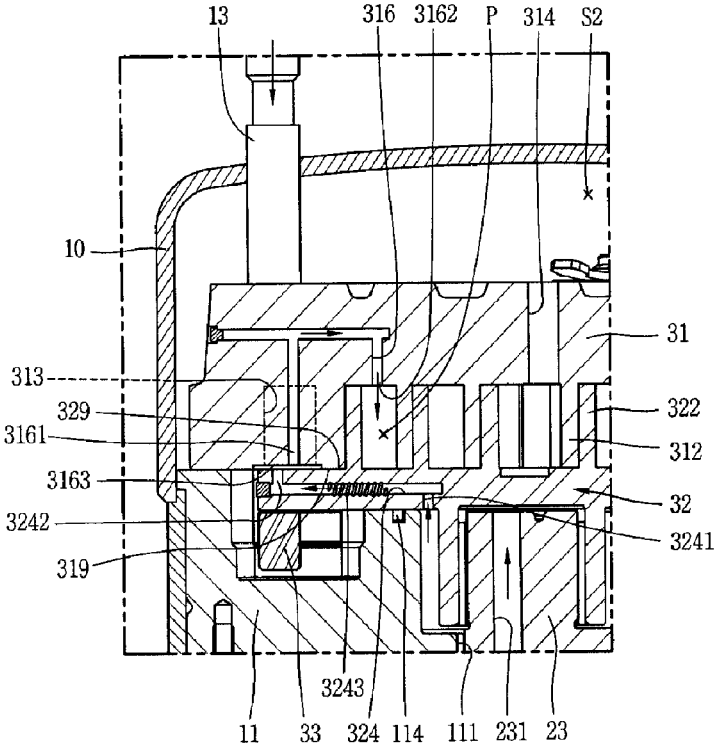
FIG. 7 is a longitudinal sectional view showing a part of a compression unit for illustrating a differential pressure channel in the scroll compressor of FIG. 1.
Figure 8:
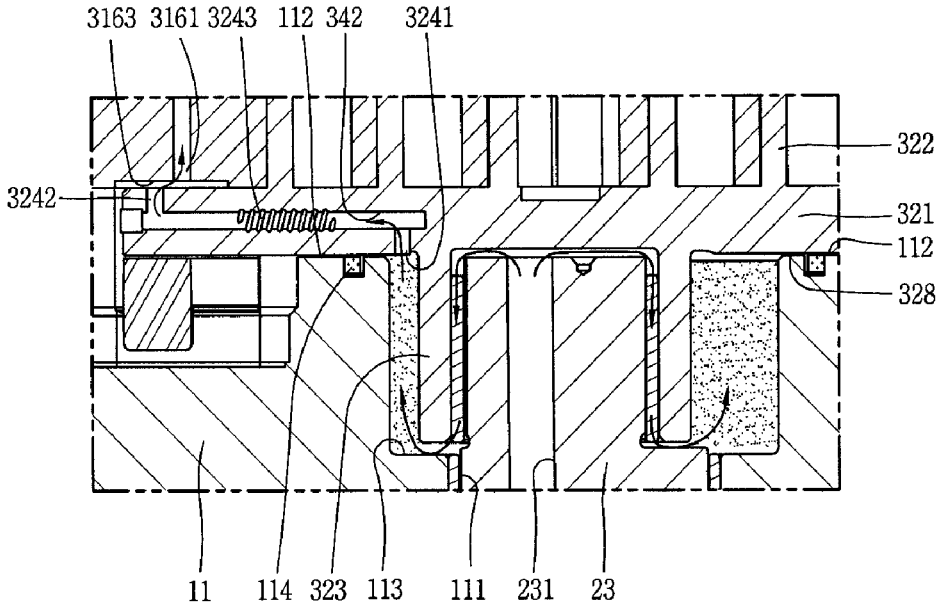
FIG. 8 is an enlarged longitudinal sectional view showing a differential pressure hole and a communication hole in the differential pressure channel according to FIG. 7.
Figure 9:
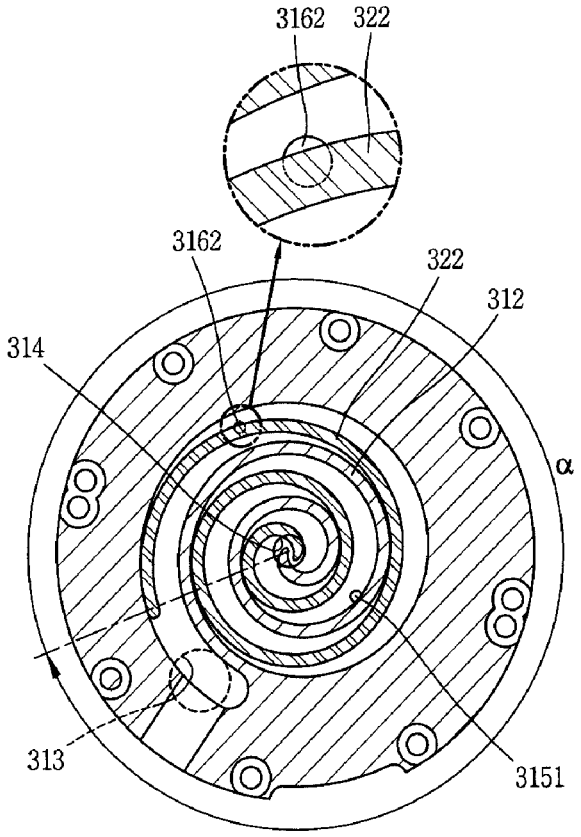
FIG. 9 is a schematic view showing a compression unit for illustrating positions of a back pressure channel and a differential pressure channel.

FIG. 7 is a longitudinal sectional view showing a part of a compression unit for illustrating a differential pressure channel in the scroll compressor of FIG. 1, FIG. 8 is an enlarged longitudinal sectional view showing a differential pressure hole and a communication hole in the differential pressure channel according to FIG. 7, and FIG. 9 is a planar view showing a compression unit for illustrating positions of a back pressure channel and a differential pressure channel.

As shown in FIGS. 7 to 9, the fixed scroll 31 may be provided with a differential pressure hole 316 which communicates with the compression chambers P at a thrust bearing surface 319 (hereinafter, referred to as first thrust surface) of the fixed scroll 31 where the fixed scroll 31 contacts the orbiting scroll 32. The orbiting scroll 32 may be provided with a communication hole 324 by which oil sucked up via the oil passage 231 is guided to a thrust bearing surface 329 (hereinafter, referred to as second thrust surface) of the orbiting scroll 32 which contacts the first thrust surface 319.

The differential pressure hole 316 may formed through so as to have a first opening end 3161 contacting the first thrust surface 319 and a second opening end 3162 contacting the compression chambers P. The second opening end 3162, as shown in FIGS. 2 and 7, may preferably be formed at a position closer to the suction groove 313 than to the second opening 3152 end 3152 of the back pressure hole 315 based on the suction groove 313 without overlapping with the second opening end 3152 of the back pressure hole 315. The second opening end 3162 of the differential pressure hole 316 may preferably be formed within a predetermined section from after complete suction of a refrigerant, such that the oil sucked up through the oil passage 231 can be sucked directly into the compression chambers P without flowing through the suction groove 313.

Here, when the second opening end 3162 of the differential pressure hole 316 is located excessively close to a discharge side, pressure of the differential pressure hole 316 increases. This may rather prevent the oil from being smoothly introduced and cause compression loss. Hence, referring to FIG. 9, a crank angle of the differential pressure hole 316 may preferably be formed approximately within 360 from a suction completion timing, namely, a timing when a suction side end of the orbiting wrap 322 contacts a side surface of the fixed wrap 312. The second opening end 3162 of the differential pressure hole 316 may preferably be formed at a position where it can independently communicate with both of the compression chambers in an alternating manner so as to supply oil into both of the compression chambers P. The second opening end 3162 of the differential pressure hole 316 may preferably be formed not to be larger than a wrap thickness of the orbiting wrap 322 in order to prevent a refrigerant leakage between the compression chambers P.

A first opening end 3241 defining an inlet of the communication hole 324 may be penetratingly formed on a thrust bearing surface 328 (hereinafter, referred to as third thrust surface) between the orbiting scroll 32 and the main frame 11, and a second opening end 3242 defining an outlet thereof may be penetratingly formed on a thrust surface 329 (hereinafter, referred to as second thrust surface) to correspond to the first opening end 3161 of the differential pressure hole 316.

The first opening end 3241 of the communication hole 324 may preferably be formed such that the oil sucked up via the oil passage 231 can be introduced into the first opening end 3241 after lubrication between the shaft receiving portion 323 of the orbiting scroll 32 and the orbiting space recess 113 of the main frame 11, thereby smoothly lubricating the orbiting scroll 32. To this end, as shown in FIG. 8, the first opening end 3241 of the communication hole 324 may preferably be formed outside the shaft receiving portion 323 based on a center of the shaft receiving portion 323, namely, between the orbiting space recess 113 and the sealing member 114.

A decompression portion 3243 may be formed inside the communication hole 324 to reduce pressure of oil which flows toward the compression chambers via the communication hole 324. The decompression portion 3243 may be applied in various ways. The exemplary embodiment may configure a decompression channel in a spiral shape at an inner circumferential surface of the communication hole 324.

At at least one of the second opening end 3242 of the communication hole 324 and the first opening end 3161 of the differential pressure hole 316 may be formed a communication groove 3163 (formed at the first opening end of the differential pressure hole in the drawing) having a wider sectional area than a sectional area of the communication hole 324 or the differential pressure hole 316, whereby an oil intake can increase.

In accordance with the scroll compressor of this specification, the oil stored in the inner space of the shell 10 can be sucked up from the inner space of the shell 10 which is a high pressure part into the compression chambers P which are a low pressure part due to pressure difference.

Here, owing to the structure that the second opening end as the outlet of the differential pressure hole 316 does not communicate with the suction groove 313 but communicates with the compression chambers P after completion of suction, oil may not be introduced into the suction groove 313, which may prevent beforehand a suction loss of a refrigerant due to the suction of oil, resulting in an improved compressor performance, compared to the differential pressure hole 316 communicating with the suction groove 313.

Hereinafter, description will be given of another exemplary embodiment of a scroll compressor.

Figure 10:
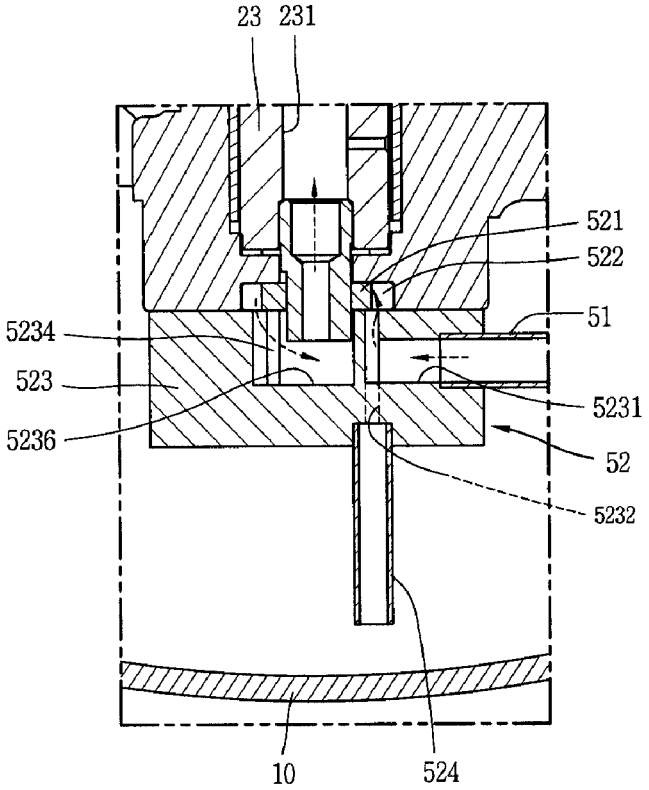
FIG. 10 is a longitudinal sectional view showing another exemplary embodiment of an oil recollecting pump in accordance with this specification.

That is, the aforementioned one exemplary embodiment has illustrated that the single inlet and the single outlet of the oil recollecting pump are independently formed such that the inlet can communicate with the oil recollecting pipe and the outlet can communicate with the inner space of the shell. However, this exemplary embodiment illustrates that the oil recollecting pump 52, as shown in FIG. 10, includes two inlets and one outlet.

In this structure, two inlets 5231 and 5232 of the oil recollecting pump 52 may communicate with the oil recollecting pipe 51 and the inner space of the shell 10, respectively, while one outlet 5234 may communicate directly with the oil passage 231 of the crankshaft 23. An oil storage portion 5236 for storing a predetermined amount of oil may further be formed in the outlet 5234. The oil storage portion 5236 may communicate with the oil passage 231 of the crankshaft 23.

Even with the configuration of the scroll compressor, pressure of the oil passage 231, in detail, pressure of the oil storage portion 5236 of the pump cover 523 is higher than pressure of the compression chambers P. Accordingly, the oil recollected via the oil recollecting pipe 51 and the oil pumped up from the inner space of the shell 10 can be sucked into the compression chambers P due to pressure difference. Also, the oil can be sucked into the compression chambers P even by the pumping force of the oil recollecting pump 52. This may allow the oil to be smoothly supplied into the compression chambers even during low-speed driving or at the beginning of driving of the compressor.

Hereinafter, description will be given of another exemplary embodiment of a scroll compressor.

Figure 11:
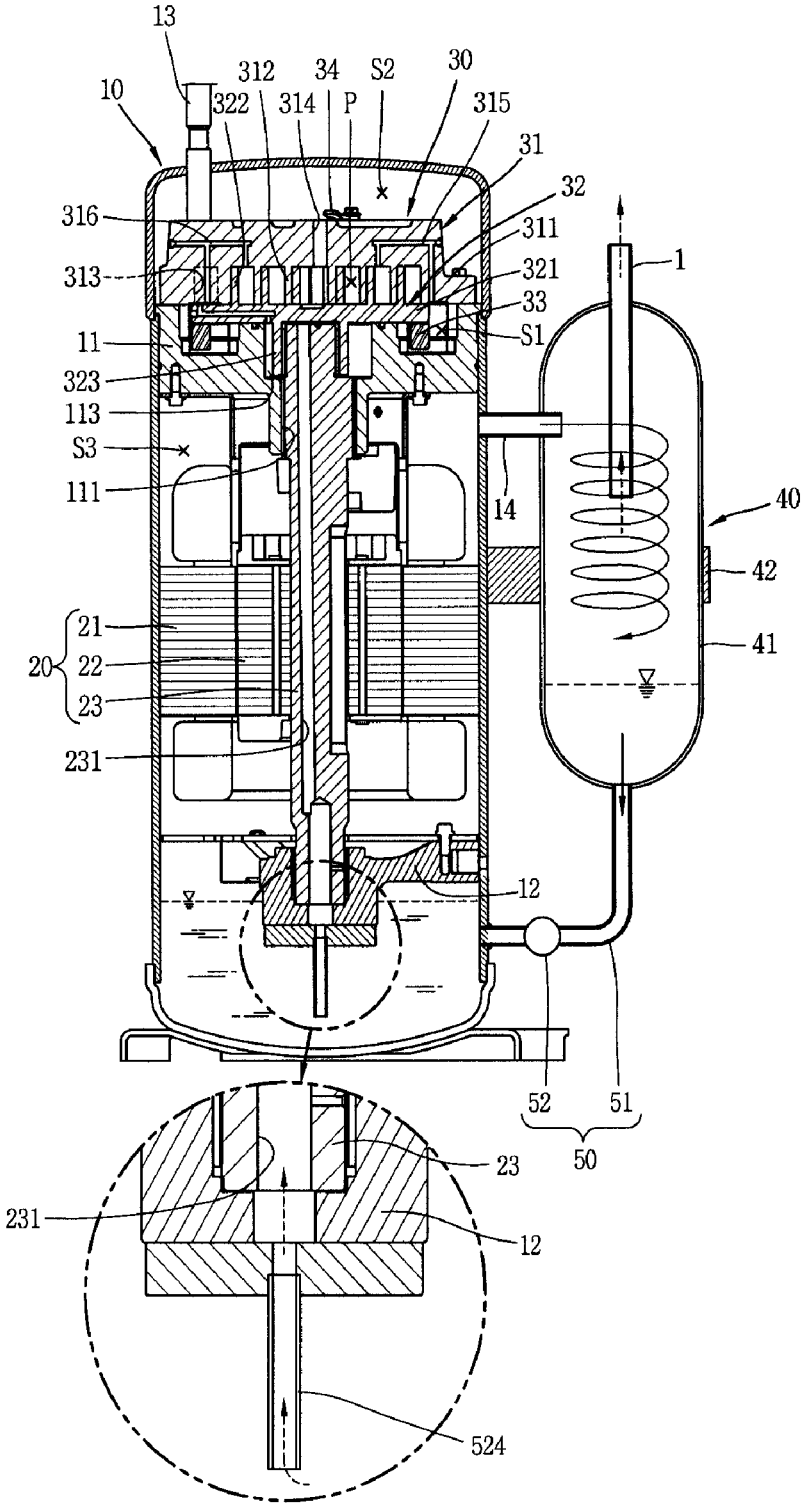
FIG. 11 is a longitudinal sectional view showing another exemplary embodiment of a scroll compressor having an oil recollecting pump located outside a shell according to this specification.

That is, the aforementioned exemplary embodiments have illustrated that the oil recollecting pump is installed inside the shell or coupled to the driving motor to use the driving force of the driving motor, whereas this exemplary embodiment illustrates that the oil recollecting pump 52 of the oil recollecting unit 50, as shown in FIG. 11, is installed outside the shell 10 and driven by a driving source separate from the driving motor 20. To this end, the oil recollecting pump 52 may be installed at a middle portion of the oil recollecting pipe 51 outside the shell 10, and an inverter motor whose rotation speed is increased or decreased in response to the rotation speed of the driving motor 20, may be installed. In addition, the oil recollecting pipe 51 may have an outlet connected directly to the oil passage 231 of the crankshaft 23, but in some cases, connected to the inner space of the shell 10.

This exemplary embodiment of the scroll compressor is substantially the same as the previous exemplary embodiments in view of basic configuration and thusly-obtained operation effect. However, in the scroll compressor according to this exemplary embodiment, the pump for pumping oil is installed outside the shell 10, not inside the shell 10, and the oil recollecting pipe 51 communicates with the inner space of the shell 10. With this configuration, foreign materials which may be contained within the oil can be filtered out within the inner space of the shell 10 and accordingly contamination of oil, which is supplied to the bearing surface, the thrust surfaces or the compression chambers P, can be prevented in advance. In addition, with the oil recollecting pump 52 installed outside the shell 10, maintenance and management of the oil recollecting pump 52 can be facilitated.

As described above, the exemplary embodiments have illustrated the scroll compressor, but the present invention may not be limited to the scroll compressor but be equally applied to a so-called hermetic compressor, such as a rotary compressor, that a driving motor and a compression unit are installed inside the same shell.

The invention claimed is:

1. A scroll compressor, comprising:

a shell having an inner space filled with a discharge pressure, the inner space storing a predetermined amount of oil;

a drive motor installed in the inner space of the shell;

a crankshaft coupled to a rotor of the drive motor, and having an oil passage formed therethrough;

a fixed scroll fixed to the inner space of the shell and having a fixed wrap;

an orbiting scroll having an orbiting wrap engaged with the fixed wrap and eccentrically coupled to the crankshaft, and configured to form compression chambers together with the fixed scroll while performing an orbiting motion with respect to the fixed scroll;

a differential pressure hole formed through the fixed scroll, wherein the differential pressure hole comprises a first opening end that communicates with the inner space of the shell and a second opening end that communicates with the compression chambers wherein the first opening end and the second opening end communicate with each other, wherein the second opening end communicates with the compression chambers after a suction completion timing, wherein the suction completion timing is a timing when a suction side end of the orbiting wrap contacts a side surface of the fixed wrap, and wherein the first opening end of the differential pressure hole communicates with a thrust hearing surface where the fixed scroll and the orbiting scroll contact each other; and a communication hole formed through the orbiting scroll, the communication hole having a first opening end and a second opening end, wherein the second opening end of the communication hole communicates with the first opening end of the differential pressure hole at the thrust bearing surface, wherein the orbiting scroll includes a shaft receiving portion coupled with the crankshaft, and wherein the first opening end of the communication hole is located outside of the shaft receiving portion in a radial direction based on a center of the shaft receiving portion.

2. The compressor of claim 1, wherein the second opening end of the differential pressure hole is located at a position at which a crank angle is within 360 degree based on a timing when a suction of a refrigerant is completed.

3. The compressor of claim 1, wherein the orbiting scroll is supported by a thrust bearing surface of a frame fixed to the shell in a thrust direction, wherein an orbiting space recess is recessed into the frame such that the shaft receiving portion is orbitaly inserted therein, wherein a sealing member is disposed between the thrust bearing surface of the frame and a thrust bearing surface of the orbiting scroll, both of the thrust bearing surfaces contacting each other, and wherein the second opening end of the communication hole is located between the orbiting space recess and the sealing member.

4. The compressor of claim 3, wherein a back pressure chamber is formed outside of the sealing member, and wherein the fixed scroll comprises a back pressure hole having a first end that communicates with the compression chambers and a second end that communicates with the back pressure chamber.

5. The compressor of claim 4, wherein the back pressure hole is formed at a position farther from a suction side than the differential pressure hole based on a moving path of the compression chambers.

6. The compressor of claim 1, wherein a decompression portion to reduce a pressure of fluid passing through the communication hole is disposed in the communication hole.

7. The compressor of claim 1, wherein a communication groove is formed at the thrust bearing surface where the fixed scroll and the orbiting scroll contact each other, wherein the communication groove is connected to at least one of the differential pressure hole or the communication hole, and wherein the communication groove has a sectional area larger than a sectional area of a hole connected with the communication hole.

8. The compressor of claim 1, further comprising an oil separator configured to separate oil from a refrigerant discharged from the compression chambers.

9. The compressor of claim 8, wherein the oil separator is installed to communicate with a middle portion of a discharge pipe at an outside of the shell, and wherein the oil separator communicates with the inner space of the shell via an oil recollecting pipe.

10. The compressor of claim 9, wherein an oil pump is disposed at the crankshaft, wherein the oil pump is driven by a rotational force of the crankshaft to pump the oil separated in the oil separator into the inner space of the shell, and wherein the oil recollecting pipe is connected to an inlet of the oil pump.

11. The compressor of claim 10, wherein the oil pump comprises one inlet and one outlet, and wherein the inlet of the oil pump communicates with the oil recollecting pipe, and the outlet of the oil pump communicates with the inner space of the shell.

12. The compressor of claim 10, wherein the oil pump comprises a plurality of inlets and one outlet, wherein one of the plurality of inlets communicates with the oil recollecting pipe and another of the plurality of inlets communicates with the inner space of the shell, and wherein the outlet of the oil pump communicates with an oil passage of the crankshaft.

13. The compressor of claim 9, wherein an oil pump is disposed at a middle portion of the oil recollecting pipe to pump the oil separated in the oil separator into the inner space of the shell.

14. A scroll compressor, comprising:

a shell having an inner space filled with a discharge pressure, the inner space storing a predetermined amount of oil;

a drive motor installed in the inner space of the shell;

a crankshaft coupled to a rotor of the drive motor, and having an oil passage formed therethrough;

a fixed scroll fixed to the inner space of the shell and having a fixed wrap; and an orbiting scroll having an orbiting wrap engaged with the fixed wrap and eccentrically coupled to the crankshaft, and configured to form compression chambers together with the fixed scroll while performing an orbiting motion with respect to the fixed scroll, wherein a differential pressure hole is formed through the fixed scroll, wherein the differential pressure hole communicates with the inner space of the shell with the compression chambers, wherein the differential pressure hole comprises a first opening end that communicates with the inner space of the shell and a second opening end that communicates with the compression chambers, wherein the first opening end and the second opening end communicate with each other, wherein the first opening end of the differential pressure hole communicates with a thrust bearing surface where the fixed scroll and the orbiting scroll contact each other, wherein the orbiting scroll is provided with a communication hole configured to communicate the inner space of the shell with the differential pressure hole, wherein the orbiting scroll comprises a shaft receiving portion coupled with the crankshaft, and wherein a first opening end of the communication hole is located outside of the shaft receiving portion in a radial direction based on a center of the shaft receiving portion.

15. The compressor of claim 14, wherein the orbiting scroll is supported by a thrust bearing surface of a frame fixed to the shell in a thrust direction, wherein an orbiting space recess is recessed into the frame such that the shaft receiving portion is orbitably inserted therein, wherein a sealing member is disposed between the thrust bearing surface of the frame and a thrust bearing surface of the orbiting scroll, both of the thrust bearing surfaces contacting each other, and wherein the second opening end of the communication hole is located between the orbiting space recess and the sealing member.

16. The compressor of claim 15, wherein a back pressure chamber is formed outside of the sealing member, and wherein the fixed scroll comprises a back pressure hole having a first end that communicates with compression chambers and a second end that communicates with the back pressure chamber.

17. The compressor of claim 16, wherein the back pressure hole is formed at a position further from a suction side than the differential pressure hole based on a moving path of the compression chambers.

* * * * *